United States Patent [19]

Kimura et al.

[11] Patent Number: 4,937,506

[45] Date of Patent: Jun. 26, 1990

[54] PHOTOMULTIPLIER TUBE USING MEANS OF PREVENTING DIVERGENCE OF ELECTRONS

[75] Inventors: Suenori Kimura; Masuo Ito; Hiroyuki Kyushima, all of Shizuoka, Japan

[73] Assignee: Hamamatsu Photonics Kabushiki Kiasha, Shizuoka, Japan

[21] Appl. No.: 228,200

[22] Filed: Aug. 4, 1988

[30] Foreign Application Priority Data

Aug. 5, 1987 [JP] Japan ..... 62-195843

[51] Int. Cl.[5] ..... H01J 43/18; H01J 40/14

[52] U.S. Cl. ..... 313/533; 250/207; 313/532

[58] Field of Search ..... 313/532, 533, 536, 537, 313/541, 542, 544, 103 CM, 105 CM; 250/213 UT, 207

[56] References Cited

U.S. PATENT DOCUMENTS

| | | | |
|---|---|---|---|
| 2,234,801 | 3/1941 | Gorlich | 313/533 |
| 3,062,962 | 11/1962 | McGee | 250/213 |
| 3,959,680 | 5/1976 | Morales | 313/95 |
| 4,678,921 | 8/1987 | Kojola | 313/532 X |

OTHER PUBLICATIONS

Roney et al., "Detector Identification with Four BGO Crystals on a Dual PMT," IEEE Transactions on Nuclear Science, vol. NS-31, No. 5, pp. 1022-1023, Oct. 1984.

Boutot et al., "Multianode Photomultiplier for Detection and Localization of Low Light Level Events," IEEE Transactions on Nuclear Science, vol. NS-34, No. 1, pp. 449, 451, 452, Feb. 1987.

Yamashita et al., "New Dual Rectangular Photomultiplier Tube for Positron CT.," IEEE Proceedings-International Workshop on Physics and Engineering in Medical Imaging, Pacific Grove, Cal., pp. 209-211, Mar. 15-18, 1982.

*Primary Examiner*—Sandra O'Shea

*Attorney, Agent, or Firm*—Finnegan, Henderson, Farabow, Garrett and Dunner

[57] ABSTRACT

A photomultiplier tube comprising a photocathode, a plurality of mesh dynodes arranged parallel to the photocathode, an anode that is disposed in a face-to-face relationship with the photocathode in such a manner that the mesh dynodes are interposed between the anode and the photocathode, the anode being divided into segments larger than the openings of each dynode, and at least one layer of focusing electrode for focusing an electron beam by the lens action which is disposed between the photocathode and the anode.

9 Claims, 4 Drawing Sheets

PHOTOMULTIPLIER TUBE USING MEANS OF PREVENTING DIVERGENCE OF ELECTRONS

BACKGROUND OF THE INVENTION

The present invention relates to a photomultiplier tube, and particularly to a photomultiplier tube capable of providing improved precision in position detection when it is used as a position detector.

Photomultiplier tubes generally are so constructed that photoelectrons generated from the photocathode as it is struck by light are progressively multiplied by a plurality of dynodes to produce intensification of incident light, which is picked up by the anode or output electrode.

A convertional photomultiplier tube employing mesh dynodes is shown in FIGS. 1(A) and 1(B). FIGS. 1(A) and 1(B) are respectively top and cross-sectional views of the conventional photomultiplier tube. The numerals 1, 2, 3 and 4 represent incident light, the photocathode, mesh dynodes and the anode, respectively. In the photomultiplier tube shown in FIGS. 1(A) and 1(B), the mesh dynodes 3 are provided in successive plural layers, in the direction of an electron stream. For example the photocathode is connected to the ground potential and a voltage of about 300 volts is applied to the first dynode. The anode is divided into segments each having a larger size than the openings of each mesh dynode so that output can be picked up from the anode segment which corresponds to the area of the photocathode where it is struck by incident light.

When light 1 is incident upon the photocathode 2 in the photomultiplier tube shown in FIG. 1(B), photoelectrons are emitted from the photocathode 2 and bombarded against each dynode 3 in turn, so that secondary electrons are emitted with multiplication at each bombardment to produce an intensified output which is picked up from the anode 4. The problem with the conventional photomultiplier tube shown in FIGS. 1(A) and 1(B) is that since the electric field applied between the photocathode and a dynode is similar to that generated between plane-parallel electrodes, an electron stream emitted from one point on the photocathode spreads progressively as it is bombarded against each dynode on account of both the energy of photoelectrons and the cosine distributed emission angle thereof. This spread in the electron stream will make it impossible to precisely determine the incident position of light on the photocathode based on an output signal from the anode segment which is in correspondence to the area of the photocathode.

As shown in FIGS. 2 and 3, the same phenomenon occurs between dynodes and between the last dynode and the anode as well; the electron stream emitted from one point on the photocathode and which is in the process of multiplication will diverge progressively to produce a pyramid-like spread on account of both the energy of secondary electrons and the cosine distributed emission angle thereof. This beam divergence also makes it impossible to precisely determine the incident position of light on the photocathode based on an output signal from the anode segment which corresponds to the area of the photocathode.

FIG. 4 is a graph showing the crosstalk that occurs as a result of the electron beam divergence as described above. The horizontal axis of the graph plots the position on the photocathode where it is scanned with a very small spot of light and the vertical axis plots the relative value of the output picked up from a certain anode segment. The crosstalk occurring in the output is indicated by the hatched area. As is clear from FIG. 4, electron beam divergence causes a crosstalk to occur over a broad range of the output.

Several ideas have been proposed to prevent the occurrence of crosstalk due to electron beam divergence and three typical approaches are described below:

(1) a plurality of tubular transmission-type dynodes are used to mechanically restrict the path or orbit of electrons as described in U.S. Pat. No. 3,062,962;

(2) a position sensitve photomultiplier tube in which the distance between the photocathode and the first dynode or the distance between adjacent dynodes is sufficiently decreased to increase the field strength so that the divergence of an electron stream is supressed to perform position detection; and (3) a plurality of small photomultiplier tubes are placed side by side.

The first approach employing a plurality of tubular transmission-type dynodes has the problem that gases might occur as a result of electron bombardment against the tubular electrodes. Furthermore, the need to arrange tubular electrodes in layers not only introduces considerable difficulty in the device fabrication process but also increases the dead space of the final product.

The second approach in which the distance between the photocathode and the first dynode or the distance between adjacent dynodes is sufficiently decreased to increase the field strength so that the divergence of electron stream is reasonably suppressed for position detecting purposes, is also defective in that precise position detection is hardly achieved because a substantial amount of crosstalk occurs as illustrated in FIG. 4. In addition, the distance between dynodes cannot be decreased indefinitely for the purpose of restricting the divergence of electron beam because the electric field to be applied between the dynodes without breaking down is limited, and therefore has a limiting value.

The third approach employing a plurality of small photomultiplier tubes arranged side by side increases the dead zone between tubes and the overall cost of the device is increased because of the need to employ a large number of tubes.

SUMMARY OF THE INVENTION

An object, therefore, of the present invention is to provide a photomultiplier tube that experiences no crosstalk due to the divergence of an electron stream and which provides not only improved position resolution but also high-speed counting.

In order to attain the object, the photomultiplier tube of the present invention comprises a photocathode, a plurality of mesh dynodes arranged parallel to the photocathode, an anode that is disposed in a face-to-face relationship with the photocathode in such a manner that the mesh dynodes are interposed between the anode and the photocathode, said anode being divided into segments each having a larger size than the openings of each dynode, and means for preventing the divergence of an electron beam emitted in the photomultiplier, the means comprising, for example, at least one layer of focusing electrode for focusing an electron beam by the lens action, which is disposed between the photocathode and the anode.

In the photomultiplier tube of the present invention, an electrode for focusing an electron stream by the lens action is disposed between the photocathode and the first dynode, and/or between adjacant dynodes and/or between the last dynode and the anode for the purpose of preventing the divergence of the electron stream. The use of such a focusing electrode enables an incident position of light to be precisely determined by the anode segment which corresponds to the area of the photocathode where it is struck by incident light. As a result, the photomultiplier tube provides an improved position resolution and realizes high-speed counting.

THE PREFERRED EMBODIMENTS OF THE INVENTION

Preferred embodiments of the present invention are described hereinafter with reference to the accompanying drawings.

Figure 1A:
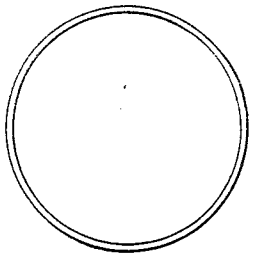
FIG. 1(A) PRIOR ART
FIG. 1(A) and 1(B) are to and cross-sectional views of a prior art photomultiplier tube which employs mesh dynodes.
Figure 1B:
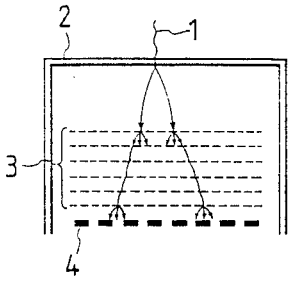
FIG. 1(B) PRIOR ART
Figure 2:
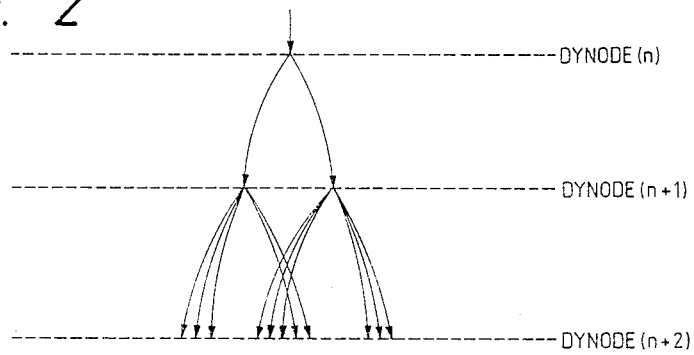
FIG. 2 is a diagram showing how an electron stream spreads between adjacent dynodes.
Figure 3:
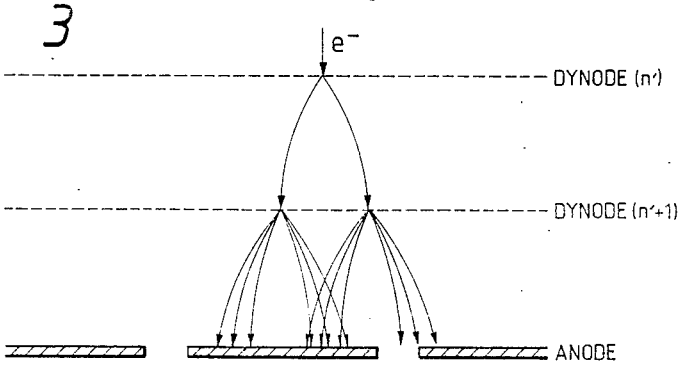
FIG. 3 is a diagram showing how an electron stream spreads between the last dynode and the anode.
Figure 4:
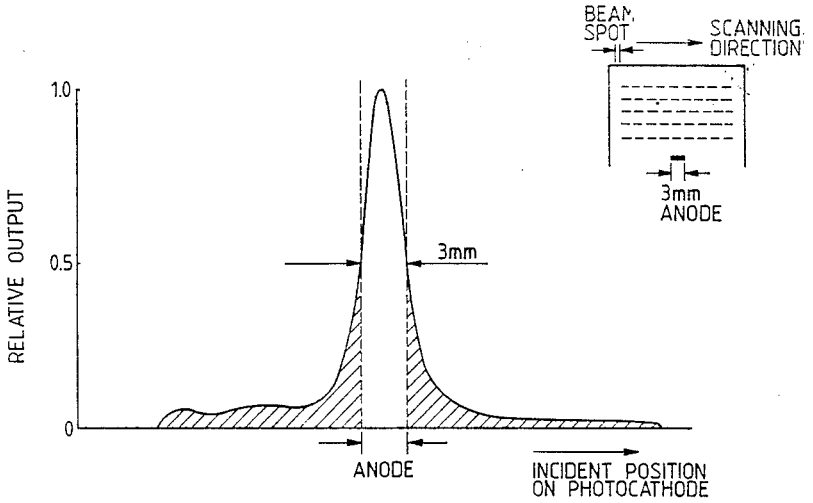
FIG. 4 is a graph showing the crosstalk occurring in the output of the prior art photomultiplier tube on account of the divergence of electron stream.
Figure 5A:
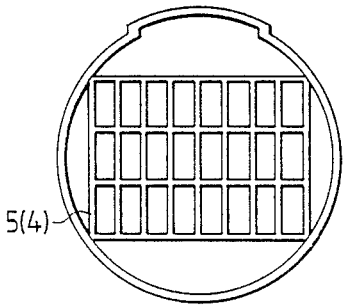
FIG. 5(A) and 5(B) are top and cross-sectional views of a photomultiplier tube provided with a projecting electrode on the photocathode in accordance with an embodiment of the present invention.
Figure 5B:
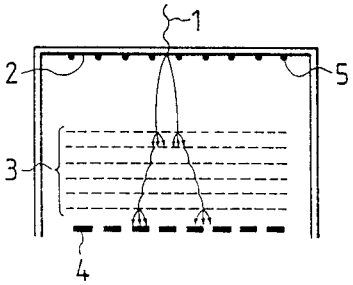

FIGS. 5(A) and 5(B) are top and cross-sectional viems of a first embodiment of the present invention and the components which are the same as those shown in FIGS. 1(A) and 1(B) are identified by like numerals. In FIG. 5(B), numeral 5 represents a projecting electrode corresponding to the contour of the anode.

In the first embodiment of the present invention, a focusing electrode 5 having the mesh form shown in FIG. 5(A) is disposed in contact with the surface of the photocathode in such a manner that it projects toward the first dynode. The openings of the projecting electrode 5 correspond to the segments of the anode 4 in both size and shape. The electrode 5 is supplied with the same potential as that applied to the photocathode.

As shown in FIG. 5(B), when light 1 is incident on the photocathode 2, photoelectrons are emitted from the point on the photocathode 2 where it was struck by the incident light. The electron stream has a tendency to spread on account of the energy of photoelectrons and the cosine distributed emission angle thereof. In the first embodiment of the present invention, the focusing electrode 5 having a closed shape (or pattern) in conformity with the contour of the anode is disposed on the photocathode downstream of the electron beam in such a manner that is projects toward the first dynode and the same potential is applied to both the photocathode and this projecting electrode 5 so that the diverging orbit of photoelectrons is appropriately corrected. After this orbit correction, the photoelectrons are bombarded against the first dynode, emitting secondary electrons which in turn are bombarded against the next dynode on the downstream side. Since this process is repeated as many times as the number of the dynodes, the electrons are multiplied and detected as an output at the anode 4. The detected output contains an appreciably decreased amount of crosstalk.

Figure 6A:
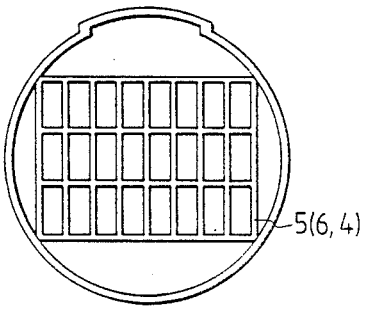
FIGS. 6 (A) and 6(B) are top and cross-sectional views of a photomultiplier tube that is also provided with an intermediate electrode between the photocathode and the first dynode in accordance with a second embodiment of the present invention.
Figure 6B:
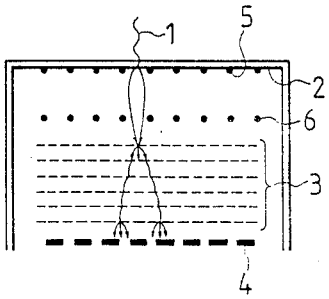

FIGS. 6(A) and 6(B) are top and cross-sectional views of a second embodiment of the present invention in which the photomultiplier tube shown in FIGS. 5(A) and 5(B) is further provided with an intermediate electrode 6 for focusing a photoelectron stream.

In the second embodiment shown in FIGS. 6(A) and 6(B), a mesh intermediate electrode 6 is provided between the photocathode and the first dynode. Like the projecting electrode 5, the openings of the intermediate electrode 6 correspond to the contour of each anode segment in size and shape. The intermediate electrode 6 is connected to the same potential as that supplied to the photocathode. The combination of the projecting electrode 5 and the intermediate electrode 6 provides a focusing electrode unit that allows an electron stream to be focused on the center of a certain anode segment which corresponds to the area of the photocathode where it is struck by incident light.

Figure 7:
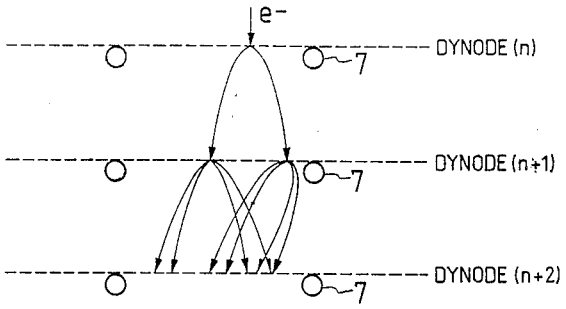
FIG. 7 is a diagram of a photomultiplier tube provided with a projecting electrode between adjacent dynodes in accordance with a third embodiment of the present invention.

FIG. 7 is a diagram showing a third embodiment of the present invention in which a projecting electrode 7 is provided in contact with each of the dynodes.

In the embodiment as shown in FIG. 7, a mesh focusing electrode 7 is disposed on the surface of at least one of dynodes at the downstream side of an electron beam. Like the projecting electrode 5 as shown in FIGS. 5 and 6, the electrode 7 has openings that correspond to the contour of each anode segment in size and shape and projects toward the anode. Each projecting electrode is supplied with the same potential as that of the dynode in contact with the projecting electrode and serves to prevent the spreading of electron beams by focusing the secondary emission from the respective dynodes.

Figure 8:
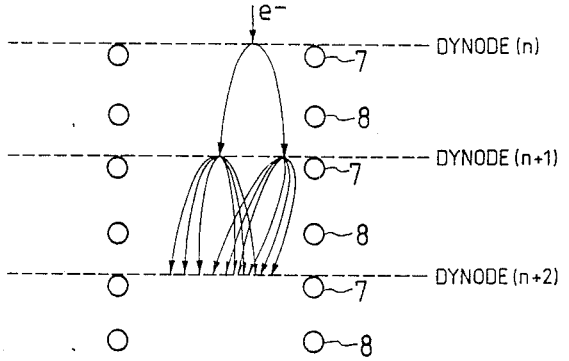
FIG. 8 is a diagram of a photomultiplier tube that is also provided with an intermediate electrode between dynodes in accordance with a fourth embodiment of the present invention.

FIG. 8 is a diagram showing a fourth embodiment of the present invention in which the photomultiplier tube shown in FIG. 7 is further provided with a focusing intermediate electrode 8 between adjacent dynodes.

In the embodiment as shown in FIG. 8, not only the projecting electrode 7 but also a mesh intermediate electrode 8 is provided between dynodes and like the intermediate electrode 6 as shown in FIGS. 5 and 6, the electrode 8 has openings that correspond to the contour of each anode segment in both size and shape and is supplied with the same potential as that of the projecting electrode corresponding thereto. The combination of the projecting electrode 7 and the intermediate electrode 8 provides a focusing electrode unit that allows more effective prevention of electron beam spreading by providing better focusing of the secondary emission from the respective dynodes.

The projecting electrode as shown in FIG. 7 or the focusing electrode unit as shown in FIG. 8 which consists of the combination of a projecting electrode and an intermediate electrode may be provided only between dynodes. Alternatively, such a focusing electrode or electrode unit may be combined with the focusing electrode as shown in FIG. 5 or the focusing electrode unit as shown in FIG. 6, and these embodiments provide even more effective prevention of electron bean spreading. A plurality of intermediate electrodes may be provided between respective adjacent dynodes in the direction of an electron stream.

Figure 9:
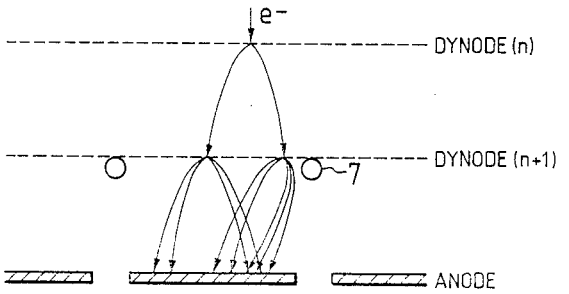
FIG. 9 is a diagram of a photomultiplier tube provided with a projecting electrode on the last dynode that faces the anode in accordance with a fifth embodiment of the present invention.

FIG. 9 is a diagram showing a fifth embodiment of the present invention in which a projecting electrode 7 is disposed in contact with the last dynode which faces the anode.

In the embodiment as shown in FIG. 9, a mesh projecting electrode 7 is provided on the last dynode (i.e., the dynode which is situated the closest to the anode) at the downstream side of an electron beam. The openings of the electrode 7 correspond to the contour of each anode segment in size and shape. Like the first to fourth embodiments, the embodiment as shown in FIG. 9 is capable of preventing the spreading of electron beams by focusing the secondary emission from the respective dynodes.

Figure 10:
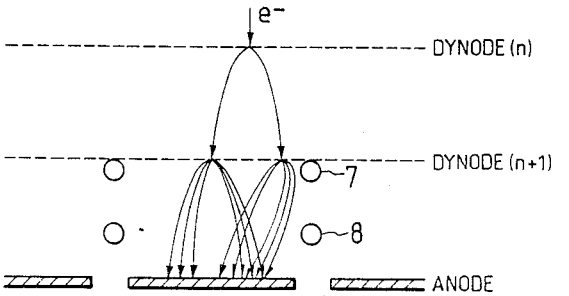
FIG. 10 is a diagram of a photomultiplier tube that is also provided with an intermediate electrode between the last dynode and the anode in accordance with a sixth embodiment of the present invention.

FIG. 10 is a diagram showing a sixth embodiment of the present invention in which the photomultiplier tube aas shown in FIG. 9 is further provided with a focusing intermediate electrode 8 between the last dynode and the anode.

In the embodiment as shown in FIG. 10, not only the projecting electrode 7 but also a mesh intermediate electrode 8 is provided at the downstream side of the last dynode which is situated the closest to the anode. The openings of the intermediate electrode 8 correspond to the contour of each anode segment in both size and shape. The combination of the projecting electrode 7 and the intermediate electrode 8 provides a focusing electrode unit that effectively prevents the spreading of electron streams by focusing the secondary emission from the respective dynodes.

Again, the projecting electrode as shown in FIG. 9 or the focusing electrode unit as shown in FIG. 10 which consists of the combination of a projecting electrode and an intermediate electrode may be provided only between the last dynode and the anode as shown in FIGS. 9 and 10. Alternatively, such a focusing electrode or electrode unit may be combined with the projecting electrode disposed between the photocathode and the first dynode as shown in FIG. 5 and/or with the focusing electrode unit shown in FIG. 6, and/or with the projecting electrode disposed between dynodes as shown in FIG. 7, and/or with the focusing electrode unit as shown in FIG. 8, and these embodiments provide even more effective prevention of electron beam spreading. A plurality of intermediate electrodes may be provided between the last dynode and the anode in the direction of an electron stream.

Figure 11A:
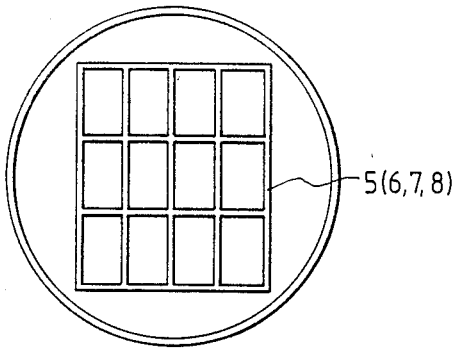
FIG. 11(A) and 11(B) are top and cross-sectional views of a photomultiplier tube according to a seventh embodiment of the present invention.
Figure 11B:
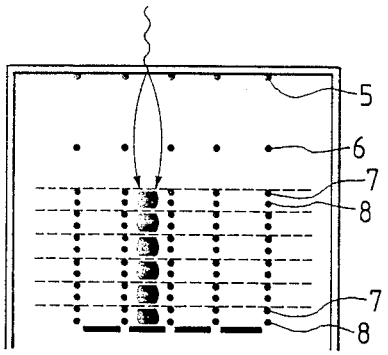

FIGS. 11(A) and 11(B) are top and cross-sectional views of a seventh embodiment in which the aforementioned projecting electrode 5 and intermediate electrode 6 are provided between the photocathode and the first dynode, and the projecting electrode 7 and intermediate electrode 8 are disposed both between dynodes and between the last dynode and the anode. This layout is also effective in preventing the spreading of photoelectron and secondary electron beams, thereby contributing to the prevention of crosstalk.

Figure 12:
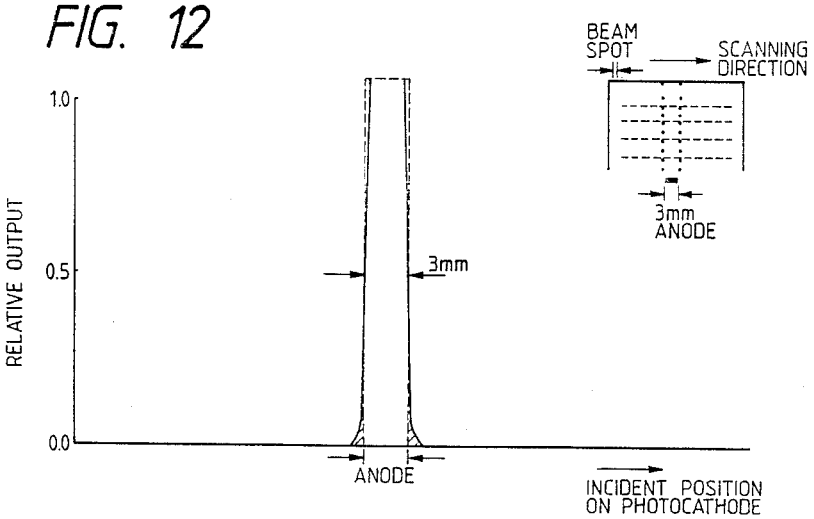
FIG. 12 is a graph showing the crosstalk occurring in the output of the photomultiplier tube of the present invention.

FIG. 12 is a graph showing the crosstalk that occur in the output of the photomultiplier tube of the present invention. The horizontal axis of the graph plots the position on the photocathode where it is scanned with a very small spot of light and the vertical axis plots the relative value of the output picked up from a certain anode segment. The crosstalk occurring in the output is indicated by the hatched area. As is clear from FIG. 12, the electron beam divergence can be sufficiently reduced in the photomultiplier of the present invention for minimizing the level of crosstalk.

As is apparent from the foregoing description, the photomultiplier tube of the present invention offers the following advantages: its output can be picked up from an anode segment corresponding to the position on the photocathode where it is struck by incident light thereby to precisely determine the incident position of light on the photocathode; it produces a crosstalk-free output; the S/N ratio of the output from each anode segment is improved; as a result, it produces an improved position resolution. The photomultiplier tube also provides an improved energy resolution if a plurality of scintillator materials are mounted on the photocathode in a pattern that corresponds to the anode segments. Conventional position detecting photomultiplier tubes relay upon measurements of the center of gravity for performing arithmetic operations for position detection, so their performance has been limited by dead times between individual center-of-gravity measurements. The photomultiplier tube of the present invention is free from this problem and provides discrete high-speed counting.

What is claimed is:

1. A photomultiplier tube for converting an incident light into intensified electrical signals, said photomultiplier tube comprising:

a photocathode for converting the incident light at a point on said photocathode into an electron beam;

a plurality of mesh dynodes, arranged parallel to said photocathode, for multiplying the electron beam;

an anode for converting the multiplied electron beam into an electrical signal, said anode being divided into segments each having a larger size than openings formed in each of said dynodes;

means for preventing divergence of the electron beam, said means being provided between said photocathode and said anode and having a shape corresponding to the contour of said segments of said anode; and said means for preventing divergence substantially directing the electron beam to a point on a segment of said anode corresponding to said point on said photocathode.

2. A photomultiplier tube according to claim 1, wherein said means comprises at least one layer of focusing electrode for focusing the electron beam by a lens action.

3. A photomultiplier tube according to claim 1, wherein said means are a focusing electrode comprising the combination of a projecting electrode disposed in contact with the surface of at least one of said photocathode and said dynodes so as to be projected downstream thereof, and an intermediate electrode spaced from said projecting electrode downstream thereof.

4. A photomultiplier tube according to claim 3, wherein said projecting electrode and said intermediate electrode of each focusing electrode comprise mesh electrodes each having a shape corresponding to the contour of said anode.

5. A photomultiplier tube according to claim 3, wherein said focusing electrode is disposed between said photocathode and the first mesh dynode facing said photocathode, between respective adjacent ones of said dynodes and between said anode and the last dynode facing said anode.

6. A photomultiplier tube for converting an incident light into intensified electrical signals, said photomultiplier tube comprising:

a photocathode for converting the incident light into an electron beam;

a plurality of mesh dynodes, arranged parallel to said photocathode, for multiplying the electron beam;

an anode for converting the multiplied electron beam into an electrical signal, said anode being divided into segments each having a larger size than openings formed in each of said dynodes;

means for preventing divergence of the electron beam, said means being provided between said photocathode and said anode; and wherein said means are a focusing electrode comprising a projecting electrode disposed in contact with the surface of at least one of said photocathode and said dynodes so as to be projected downstream of the electron beam.

7. A photomultiplier tube according to claim 6, wherein said projecting electrode comprises a mesh electrode having a shape corresponding to the contour of said anode.

8. A photomultiplier tube according to claim 6, wherein said focusing electrode is supplied with the same potential as that of one of said photocathode and said dynodes which is in contact with said focusing electrode.

9. A photomultiplier tube for converting an incident light into intensified electrical signals, said photomultiplier tube comprising:

a photocathode for converting the incident light into an electron beam;

a plurality of mesh dynodes, arranged parallel to said photocathode, for multiplying the electron beam;

an anode for converting the multiplied electron beam into an electrical signal, said anode being divided into segments each having a larger size than openings formed in each of the dynodes;

means for preventing divergence of the electron beam, said means being provided between said photocathode and said anode; and wherein said means are a focusing electrode comprising the combination of a projecting electrode disposed in contact with the surface of at least one of said photocathode and said dynodes so as to be projected downstream thereof, and an intermediate electrode spaced from said projecting electrode downstream thereof; and said focusing electrode is supplied with the same potential as that of one of said photocathode and said dynodes which are in contact with said focusing electrode.

* * * * *